US005729214A

United States Patent [19]

Moore

[11] Patent Number: 5,729,214

[45] Date of Patent: Mar. 17, 1998

[54] CONDITION REACTIVE DISPLAY MEDIUM

[76] Inventor: Steven Jerome Moore, 9 Sonoma Rd., Cortlandt Manor, N.Y. 10566

[21] Appl. No.: 581,802

[22] Filed: Jan. 2, 1996

[51] Int. Cl.[6] ..... G08G 1/09

[52] U.S. Cl. ..... 340/905; 340/907; 340/908.1; 340/910; 340/917; 340/934; 340/939; 340/525; 364/436; 364/437

[58] Field of Search ..... 340/901–908.1, 340/928, 933, 917, 934, 939, 525, 910; 364/435–438

[56] References Cited

U.S. PATENT DOCUMENTS 3,614,727 10/1971 Fritts .
4,727,371 2/1988 Wulkowicz ..... 340/905
4,896,153 1/1990 Pastorino ..... 340/906
4,985,705 1/1991 Stammler ..... 340/910
5,131,020 7/1992 Liebesny et al. ..... 340/905
5,289,183 2/1994 Hassett et al. ..... 340/905
5,317,311 5/1994 Martell et al. ..... 340/905

*Primary Examiner*—Donnie L. Crosland

[57] ABSTRACT

Digitally-effectuated, automatic control over the message or messages displayed on one or more programmable display mediums in response to changing conditions, or anticipated changing conditions, in the vicinity of the display mediums is disclosed.

11 Claims, 8 Drawing Sheets

CONDITION REACTIVE DISPLAY MEDIUM

BACKGROUND OF INVENTION

1. Field of Invention

The field of the present invention generally relates a remotely controlled message display system. More particularly it relates to a method and system for altering the message on one or more signs or displays in response to ambient or anticipated conditions in the vicinity of the sign.

2. Brief Description of the Prior Art

Signs abound in our daily lives. Signs provide a means to identify, advertise, command, warn, to inform, and to provide direction. Traditional signs, which have been commonplace since the dawn of human civilization, consist of a board upon which writing or illustration is placed. Billions of traditional signs are found on the face of the earth today.

While traditional signs are quite commonplace, such signs suffer from a number of disadvantages. The primary problem with such signs is that they are generally unalterable. Thus, if conditions which caused the sign to be produced and hung in position change, the only expeditious way of correcting the sign's message is to remove it and replace it with another more appropriate sign. Such inter-change can be time consuming and expensive. Further, such signs are incapable of being read at night by themselves without the provision of an external light source.

In order to overcome the problems associated with traditional signs, there has been developed internally-lighted signs with replaceable indicia. These signs, which are fairly commonplace outside of businesses and events, generally comprise a partially transparent housing providing a means for replaceably attaching partially translucent letters or numbers thereto, and a light source, such as a number of incandescent or fluorescent light bulbs within the housing. While the message on such signs is variable, such signs suffer from two major drawbacks—the need for manual labor to change the sign's message and relatively high power consumption.

In the quest for a less labor intensive method of changing a lighted display's message, there have been developed programmable displays capable of storing and displaying one of several possible messages. U.S. Pat. No. 4,298,869 to Okuno describes such a programmable display comprising a sign equipped with light-emitting diode (LED) lamps for displaying information with respect to place-name, weather condition and occurrence of accident and/or traffic jam. Besides permitting a number of different messages to be displayed, LED-based programmable signs further provide visibility of the message at night without the need for provision of an external light. LED-based programmable signs have become fairly commonplace along many major highways (e.g. coupled with a speed sensor to display to a driver his or her excessive speed) and have even been proposed to replace traditional bill boards.

The problem with LED-based signs is that they are generally bulky and costly to operate. Further they often do not provide adequate contrast in bright light, that is the sign's message is often "washed-out" by ambient light. As pointed out in the prior art, the problem relating to bulkiness is adequately dispensed with by equipping a programmable sign with a liquid crystal display. The problem with conventional liquid crystal displays, however, is that the messages displayed thereon are also often "washed-out" by ambient light and further suffer from angle of view limitations. U.S. Pat. No. 5,331,448 to Kajiyama et al. discloses a liquid crystal display that is said to overcome these problems and is said to permit the manufacture of thin signs having excellent message visibility and durability and at the same time providing for a large angle of view field. The liquid crystal device is described as having a pair of electrodes at least one of which is transparent and a mixture film of side-chain type liquid crystalline polymer and at least two low molecular weight liquid crystals which film is sandwiched between the pair of electrodes, wherein the mixture film contains 0.005 to 1% by weight of an electrolyte based on a total weight of the mixture film. The device is said to provide variable message capabilities conducive for use in variable traffic control signs.

The message to be displayed on a programmable display is typically chosen by input means intimately correlated with the display. However, remote control of programmable displays is known. For example, U.S. Pat. No. 5,309,174 to Minkus describes an electronic display system in which various messages are remotely provided to a display, and information regarding the display and/or message may be provided to the control location. U.S. Pat. No. 5,061,921 to Lesko describes a remote-controlled message sign having a plurality of display indicia mounted on a frame for movement between a plurality of positions, such sign frame being responsive to a pager signal.

The remote control display systems of the prior art suffer from several distinct problems. First, such systems are designed such that only one display responds to a given signal. Such systems make no provision for situations in which it is desirable to expeditiously change the message displayed on a plurality of displays all at once. Second such systems are designed such that manual input of data related to a particular message change is required. Such systems are not designed so as to permit automatic message response to a changed conditions. Finally, such remote systems typically involve connection to a remote station by transmission lines or telephone lines or are responsive to simple analog radio transmissions. Direct coupling to electrical lines is by its very nature quite expensive. Analog transmission to a multiplicity of programmable signs may be impractical given the need for licensing approval to operate in several magnetic spectrum bandwidths.

A relatively recent development in the transmission art is digital signal transmission. Digital transmission involves the conversion of analog input signals to digital equivalents, digitally modulating the equivalents and transmitting the same over the air waves, receiving the digital signals, and reconverting the digital signals back to the original analog forms. Digital transmission techniques have been rapidly adopted in the fields of cellular telecommunications and television and audio broadcasting. Digitalized signals permit enhanced communication owing to less susceptibility to noise and interference than comparable analog signals and permit broadcast of signals with considerably less noise in the output. Because of the character of the transmission, multiple digitally modulated signals generally occupy less electromagnetic spectrum bandwidth than comparable multiple analog signals. U.S. Pat. Nos. 5,179,576 and 5,390,214 to Hopkins et al. describes a system for the digitalization and subsequent transmission of an analog radio signal comprising an analog signal compressor in electrical communication with a digitizer, an encoder circuit for encoding the digital signal from the digitizer in such a manner as to allow for correction of lost or inaccurate data at the receiving station, an RF modulator for modulating the encoded data at an RF frequency, a power amplifier for amplifying the digital signal, and a transmitter antenna from which the modulated RF signal is sent over the air waves to one or more receiving stations.

It is believed that wireless digital transmissions have heretofore not been applied to the remote control of programmable display mediums, such as signs and billboards. Such transmission method offers many advantages for such control systems, not only in the reduction of noise in the signal received by the display medium, by also in permitting improved re-programming of the messages to be displayed on a plurality of display mediums.

SUMMARY OF THE INVENTION

The disadvantages of the prior art are overcome in accordance with the present invention by providing wireless, digitally-effectuated, automatic control over the message or messages displayed on one or more programmable display mediums in response to changing conditions, or anticipated changing conditions, in the vicinity of the display mediums. Control over the identity of the display medium which (is)are to respond to a particular display command may be carried out by encodation of digital keys at one or more fixed bit positions in the transmission bit stream which are recognizable by the display medium processors of certain display mediums, but unrecognizable by other display medium processors, such digital keys unlocking the display medium processor so as to permit re-reprogramming of the message or messages to be displayed on the display medium in accordance with the display command portion of the signal.

In accordance with the invention, there is also provided one or more condition monitors for detecting ambient conditions in the vicinity of such monitors. Such condition monitors provide direct or indirect input to the display processor of a programmable display medium, such input by pre-programmed means being used to effectuate a change in the message or messages displayed on a particular display medium. Conditions which may be monitored are varied and include, for example, weather, traffic patterns, road conditions and degree of darkness. Various detecting devices known in the art may be coupled to a monitor processor including barometric pressure and humidity detectors (useful in monitoring weather conditions), acoustic sounding detectors (useful for adjudging the amount of traffic passing by a condition monitor), thermocouple-based detectors (useful for determining freezing on roads), and light-sensitive detectors (useful for adjudging the degree of darkness). While such condition monitor processor may be directly coupled to the display processor, or may be the display processor itself, and thus provide direct input with regard to changing conditions, it is preferred that such condition monitors be free standing and that the signal relating to changed conditions generated by the condition monitor be used to effectuate display message changes in a plurality of display mediums.

In one embodiment, the condition monitor transmits an analog, or preferably a digital, signal to a central station upon detecting a change in ambient conditions in the vicinity of the condition monitor. The central station processes the condition monitor signal, and in conjunction with any other signals received from other condition monitors in proximity to the condition monitor, calculates, preferably by pre-programmed means, whether the message displayed on one or more display mediums should be altered. The central station then transmits a command transmission signal directed at one or more display mediums to effectuate an alteration in the message displayed on the display mediums. Preferably such central station transmission is a digital transmission having numerous data blocks among which is an encoded key located at one or more fixed bit positions in the transmission bit stream which is recognizable by the display medium processors of certain display mediums, but unrecognizable by the display medium processors of other display mediums, such digital keys unlocking the display medium processor so as to permit broadcast or re-programming of the message or messages to be displayed on the display medium in accordance with the display command portion of the signal. Digital signal transmission and encoding may be performed by any means known in the art, for example as described in U.S. Pat. No. 5,444,490 to de With et al. with respect to transmission of television signals or as described in U.S. Pat. No. 5,381,143 to Shimoyoshi et al. generally. Preferably, the processor of the display medium whose display is altered is coupled to display sensors capable of detecting parameters related to the display such as pixels "on" or illumination of the system, and such processor is connected to a transmitter for transmitting information pertaining to the display parameters to the central station for confirmation that both the command has been transacted and that the display medium is in working order.

As discussed in U.S. Pat. No. 5,179,576 to Hopkins et al., FM transmission verses AM transmission may be preferred since typically FM offers clearer signal reception than AM and, unlike AM transmission, is not prone to the inherent susceptibility of the receiver to amplify modulated signals that are produced by electrical discharges such as lightning and high power transmission lines.

While the transmission link between condition monitor and central processing station, and central processing station and display medium(s), may encompass standard transmitter-receiver radio transmission technology, the transmission link may also encompass conventional cellular telephone technology. Such conventional technology is discussed in U.S. Pat. No. 5,440,613 to Fuentes. In such an embodiment, a transceiver connected to the condition monitor processor transmits a condition signal to a cell site via cellular telephone hook-up. By means well known in the art, the message is switched to a public switched telephone network and thereby transmitted to the central station. By hook-up through the cell site, the central station can communicate through the display medium transceiver with the display medium processor and alter the message or messages displayed thereon.

Communications may also be linked by satellite means. U.S. Pat. No. 5,433,726 to Horstein et al. describes a satellite-based telecommunications system requiring as little as nine satellites to provide complete global coverage of the earth and significantly reducing beam-to-beam and satellite-to-satellite handovers, thereby dramatically reducing the likelihood of dropouts. In this embodiment, transmissions, preferably digital in nature, are focused at a satellite that directs the transmission to the appropriate transceiver(s) in the system, for example a transmission from the condition monitor to the central processing station, from the central processing station to a display medium, and from a display medium to the central processing station.

The present invention also provides for anticipated changed condition input unrelated to the detection means of the condition monitors. In this aspect of the invention, input regarding such matters as construction work schedules (e.g. whether road crews are on the highway or not), anticipated detour schedules etc. are entered at the central processing station. Preferably by pre-programmed means, the central processing station processor is prompted to alter the message displayed on one or more display mediums with respect to the anticipated changed condition at the time of anticipated change.

Also disclosed is a display system comprising: a display medium means having a display for displaying messages; a condition monitor means for monitoring ambient conditions in the vicinity of said condition monitor and transmitting a condition signal with respect to changed ambient conditions; and a central processing means disposed at a remote location from said display medium means and said condition monitor means having a transmission means for transmitting a control signal in response to said condition monitor means signal for initiating a message for display on said display.

Also disclosed is a display system comprising: a display medium means having a display for displaying messages; a central processing means disposed at a remote location form said display medium means having a transmission means for transmitting a control signal in response to pre-inputted data with respect to conditions anticipated to change over time to said display medium, such control signal controlling the message or messages displayed upon said display medium.

In one embodiment, the change message signal from the central processing station may activate a change in message on the display medium and/or a functionality intimated with a display medium or non-display medium. Such functionalities include a means to remotely move the display medium, such as a motor connected to a set of wheels by a mechanical linkage or a means for extending and retracting a protrusion from the medium such protrusion being used to block off a portion of a transit lane or other area from ingress or egress.

Further disclosed is a traffic control system for blocking off a portion of a transit lane or other area from ingress or egress comprising: a plurality of medium each having a means for extending and retracting a protrusion means; a plurality of medium transceiver means attached to each of said medium processor means for receiving control signals; a central processing means disposed at a remote location from said plurality of mediums having a transceiver means for transmitting a control signal for receipt by one or more said medium transceiver means, and for initiating extension or retraction of said protrusion means for one or more of said mediums. The control signal may be responsive to pre-programmed input regarding anticipated traffic conditions. The control signal may be digital in nature and may be comprised of numerous data blocks. Certain of the data blocks may be interpretable by certain of said plurality of medium processors as command signals with respect to the state of retraction or extension of said protrusion means. The data blocks may be interpretable by certain of said medium processors as key codes for unlocking said medium processor so as to permit control over the extension or retraction of said protrusion means in accordance with the command portion of the signal.

DETAILED DESCRIPTION OF THE ILLUSTRATIVE EMBODIMENT OF THE PRESENT INVENTION

Figure 1:
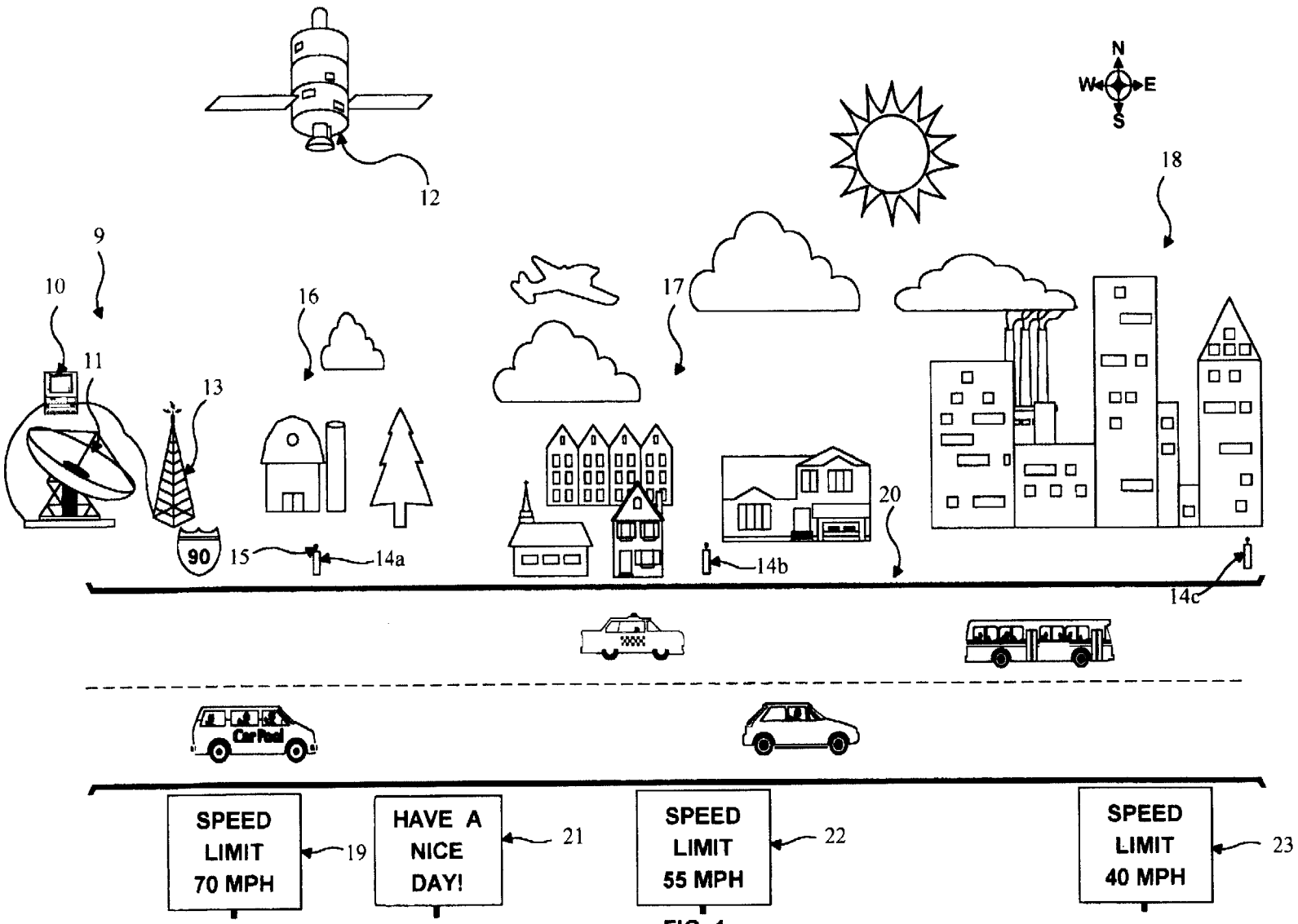
FIG. 1 is a pictorial illustration of an embodiment of the present invention in an inactivated state.

FIG. 1 is a pictorial illustration of an embodiment of the present invention in an inactivated state. In the embodiment of FIG. 1, condition monitors 14*a*, 14*b*, 14*c*, for monitoring ambient conditions, are placed along select locations on transit route 20, as for example, as depicted, a rural 16, suburban 17 and urban 18 locality. Condition monitors 14*a*, 14*b*, 14*c* may be used to measure changes in numerous conditions, such as weather as depicted in FIG. 1. Display mediums 19, 21, 22 and 23 are also placed along transit route 20 in a reasoned fashion. Display mediums 19, 21, 22 and 23 have a transceiver means (not shown) for receiving command signals from central processing station 9 with respect to the message (which may be words or illustrations) to be displayed on their displays and for transmitting display signals with respect to the current status of the display to central processing station 9 after transacting a change in display message. Central processing station 9 comprises a communication means, such as satellite dish 11 or radio tower is and a processing means 10 for processing data. Display mediums 19, 21, 22 and 23 are pre-programmed to display a particular message on their displays if they do not receive a contravening command signal otherwise. FIG. 1 depicts possible default messages that may appear on such display medium when weather conditions are within "normal" ranges.

Figure 2:
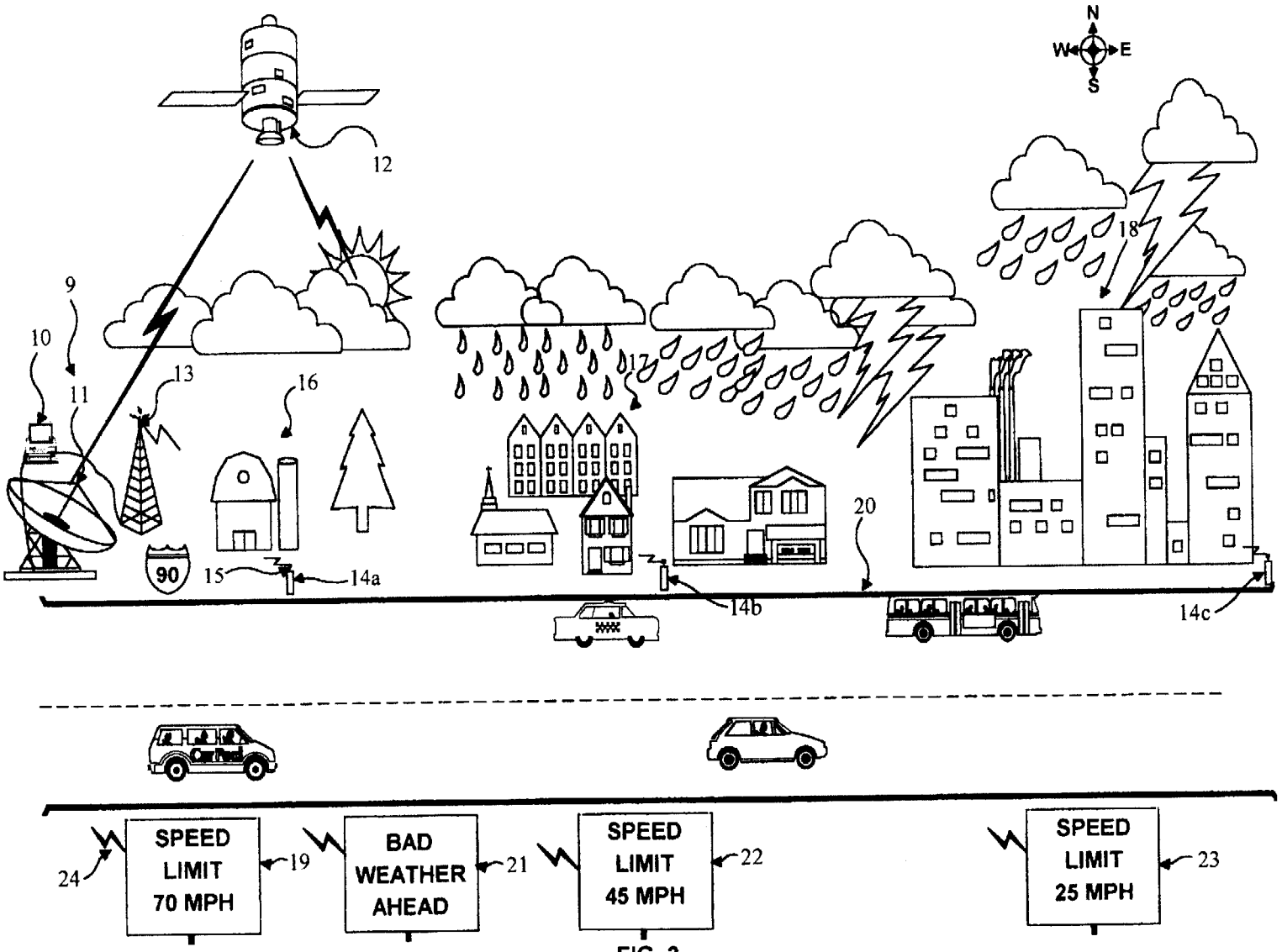
FIG. 2 is a pictorial illustration of an embodiment of the present invention activated by poor weather conditions.

FIG. 2 is a pictorial illustration of an embodiment of the present invention activated by poor weather conditions. As depicted in FIG. 2, condition monitor 14*b* is activated by rain conditions such as to send a changed condition signal to central processing station 9 by means of transmission from condition monitor antenna 15 to radio tower 13, or through satellite 12 and satellite dish 11. The changed condition monitor signal is processed by central processing station processing unit 10 and a command signal keyed to the appropriate display mediums is generated and transmitted. The display medium 19 to which the command signal 24 is keyed reacts in accordance with the command portion of the signal to alter its display. In FIG. 2, condition monitor 14*a* reacts to cloudy conditions, condition monitor 14*b* to rainy conditions, and 14*c* to stormy conditions and each transmits a signal with respect to such weather conditions to central processing station 9. Processing means 10 at central processing station 9 processes the information with respect to the weather conditions in each locality and by programming means transmits command signals with respect to one or more display medium. As depicted, display medium 19 displays a speed limit 5 miles-per-hour lower, display medium 22 a speed limit of 10 miles-per-hour lower, and display medium 23 a speed limit of 15 miles-per-hour lower, than the corresponding display medium in FIG. 1.

Figure 3:
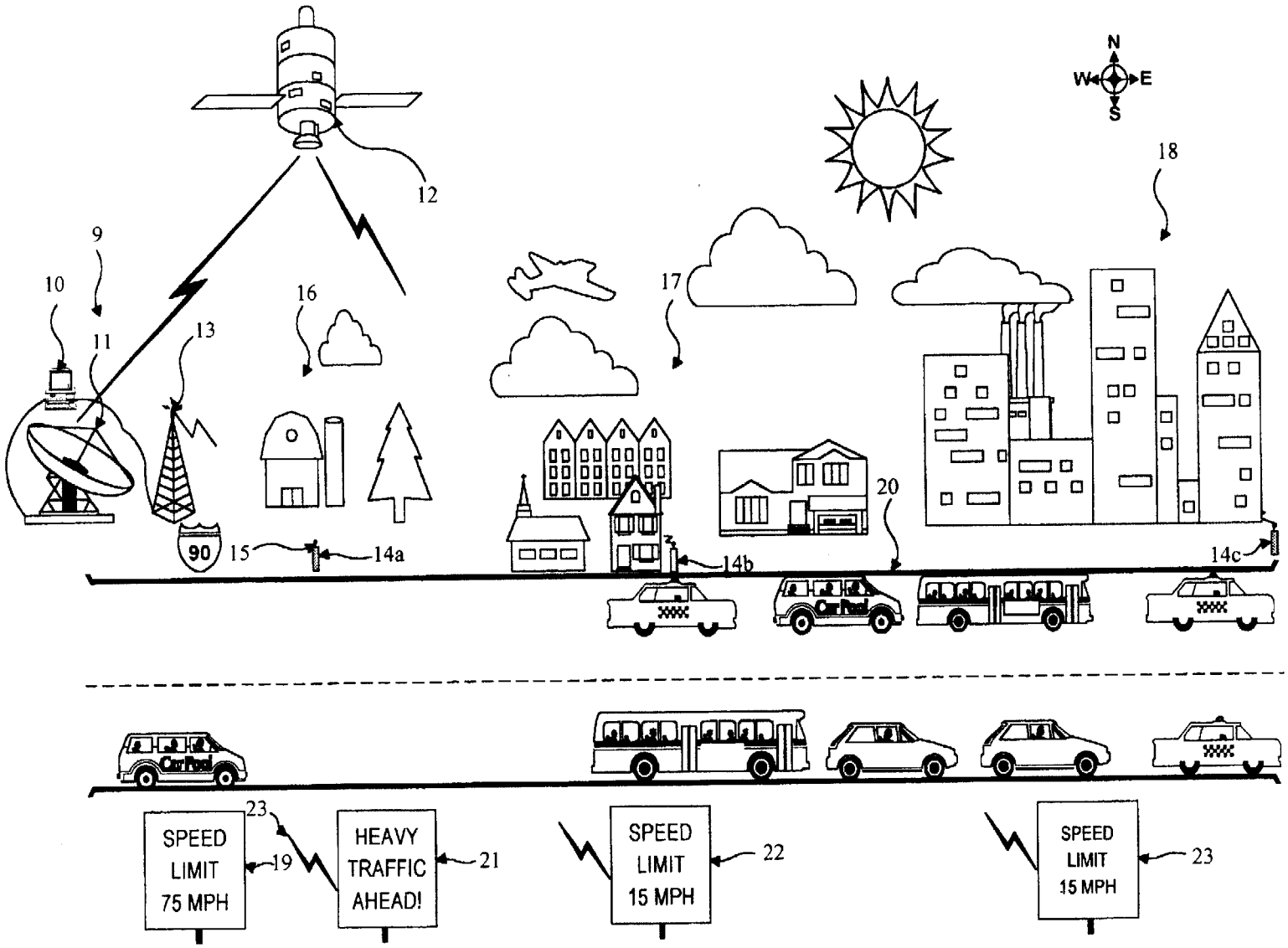
FIG. 3 is a pictorial illustration of an embodiment of the present invention activated by traffic conditions.

Now referring to FIG. 3, there is shown a pictorial illustration of an embodiment of the present invention activated by traffic conditions. As shown, condition monitors 14*b* and 14*c* react to traffic build-up and transmit signals with respect to such condition to central processing station 9. Central processing station 9 after processing such condition data, sends a signal to change the display on display mediums 21, 22 and 23, as shown.

Figure 4:
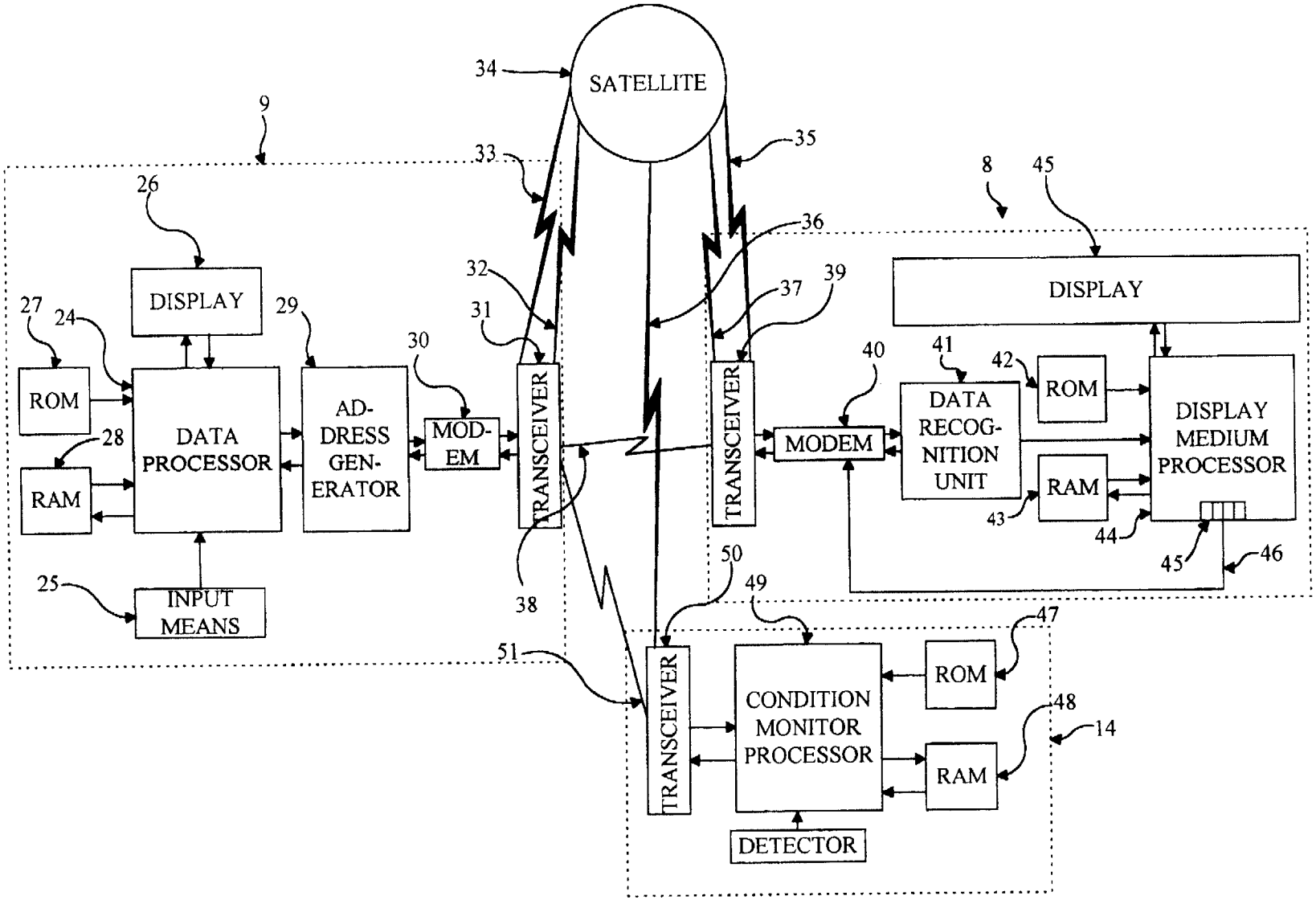
FIG. 4 is a block diagram of a system according to the disclosed invention employing satellite transmission linkage.

Now referring to FIG. 4, there is shown a block diagram of a system according to the disclosed invention employing satellite transmission linkage. Condition monitor 14 comprises a condition monitor processor 49 having ROM 47 and RAM48 memory capacities, one or more ambient condition detectors 7, and a transceiver means 50 for sending signals, e.g. signal 36, 33 by satellite linkage, signal 51 by radio tower linkage, with respect to changed ambient conditions in the vicinity of condition monitor 14 to, and for receiving re-programming signals from, central processing station 9. Central processing station 9 includes a data processing means 24 for processing data with respect to changed conditions attendant to a condition monitor 14 received through transceiver 31, or anticipated changes input into data processing means 24 byway of input means 25. Data processing means 24 has both ROM memory 27 for storing programs, and RAM memory 28 for data manipulation work space. Data processing means 24 further has fixed memory storage storing commands which may include messages or graphical compositions or simple commands recognizable by a display processor of a display medium. Associated with data processing means 24 is a display screen 26 on which can be viewed both the changed condition data and the command to be sent to one or more display monitors. Data processing means 24 may be a general purpose digital computer. Connected to data processing means 24 is address generator 29 which is capable of accessing the command storage memory of data processing means 24 to cause the contents thereof to be read out of the memory, or cause data to be read into the memory. In practice, address generator 29 may be a part of data processing means 24, particularly in those cases where the data processing means is a general purpose digital computer. As data representing a command is read out of memory from the control location, it is passed to a radio-frequency modem 30 for transmission by radio waves as command signals 32 from transceiver 31 to satellite 34. The transmitted command signal 32 may be in digitalized form using methods well known in the art as described, for example, in the prior art disclosure hereof. Satellite 34 re-transmits the command signal 37 for pick-up by display medium 8 by means of display medium transceiver 39. Display medium transceiver 39 is coupled to display medium modem 40, which in turn is coupled to data recognition unit 41. Data recognition unit 41, which is typically processor-based, determines if a received transmission contains one or more key encryption codes which are in accordance with a key protocol programmed into the data recognition unit. In this respect, key encryptions in a command signal may be specific for a certain display medium or may be specific for a plurality of display mediums, or may be non-specific for all display mediums. Command data encompassed in the command signal is then sent by the data recognition unit to display medium processor 44. Display medium processsor 44 has RAM memory 43, ROM memory 42 and preferably fixed memory (not shown). Display medium processor 44 processes either a command with respect to which message or messages stored in display medium fixed memory should be displayed, or stores a command in the form of a message or graphical composition in fixed memory for subsequent display that was encoded in the command signal. Display medium processor 44 further executes the command so as to display the requested message or graphical composition on display 45. Display medium may also comprise one or more display sensors 45 for sensing parameters related to the displayed message itself or for sensing parameters with respect to the function of the display medium processor and other electronic components of the display medium. Output from display sensors 45 may be connected by connection means 46 through modem 40 to display medium transceiver 39 for transmitting a signal with respect to the such sensed parameters such as satellite-linked signal 35, 33 or radio tower-linked signal 38 to central processing station 9.

Figure 5:
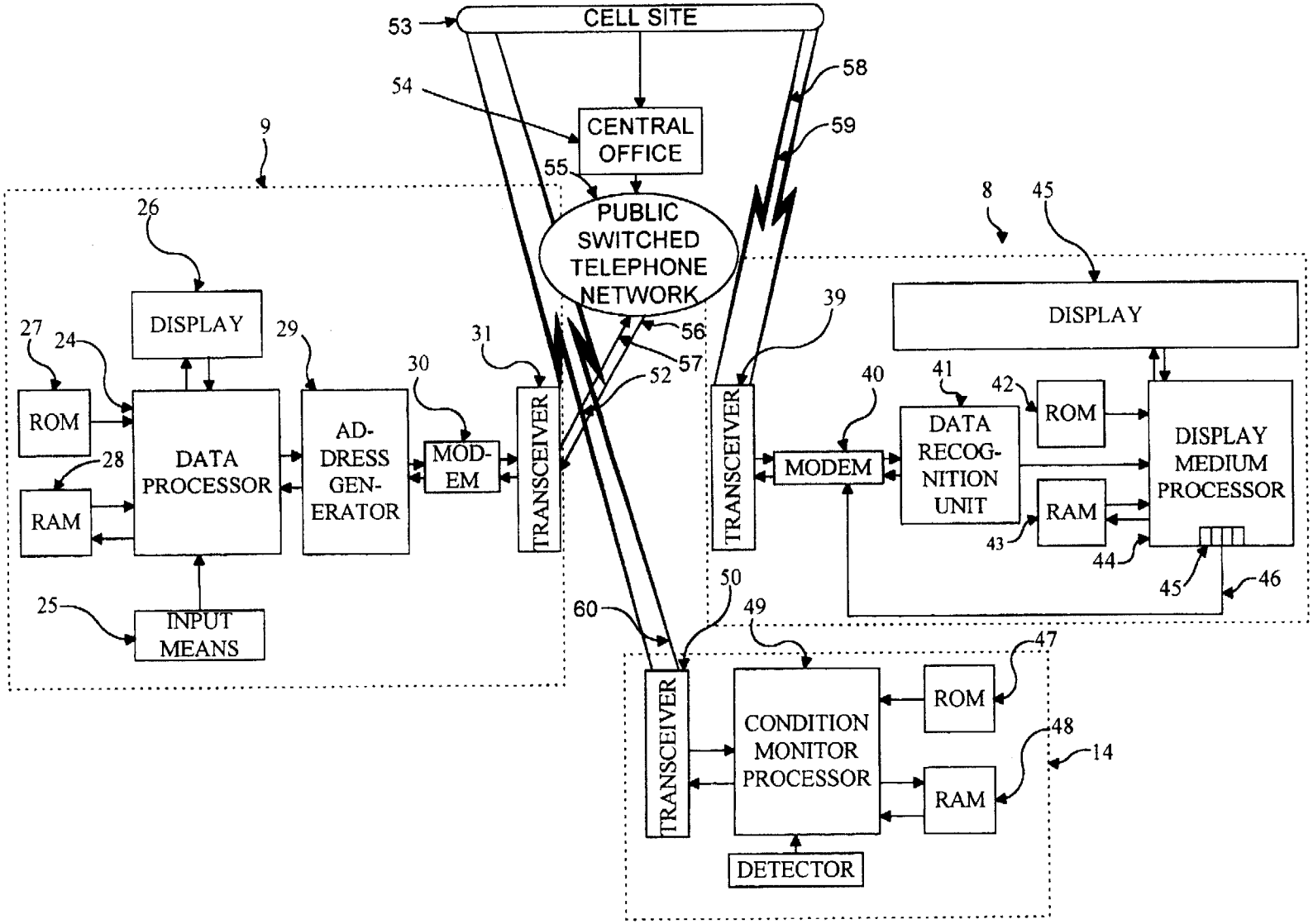
FIG. 5 is a block diagram of a system according to the invention employing cellular communication linkage.

FIG. 5 is a block diagram of a system, similar to that described with respect to FIG. 4, but employing cellular communication linkage rather than satellite-based communication linkage between the components of the system. In such a system, condition monitor 14 and display medium 8 are connected via telecommunication means 52 to cell site 53. As is conventional in cellular communications, cell site 53 is linked to a central office 54 which is interconnected to public switched telephone network 55. Central processing station 9 is linked 56, 57 through public switched telephone network and therefore to display medium 8 and condition monitor 14. In such a system, data processor 24 is preprogrammed with the telephone number of a multiplicity of display mediums 8 and contacts display medium 8 by dialing the phone numbers associated with particular signs and transmitting the command signal thereto.

Figure 6:
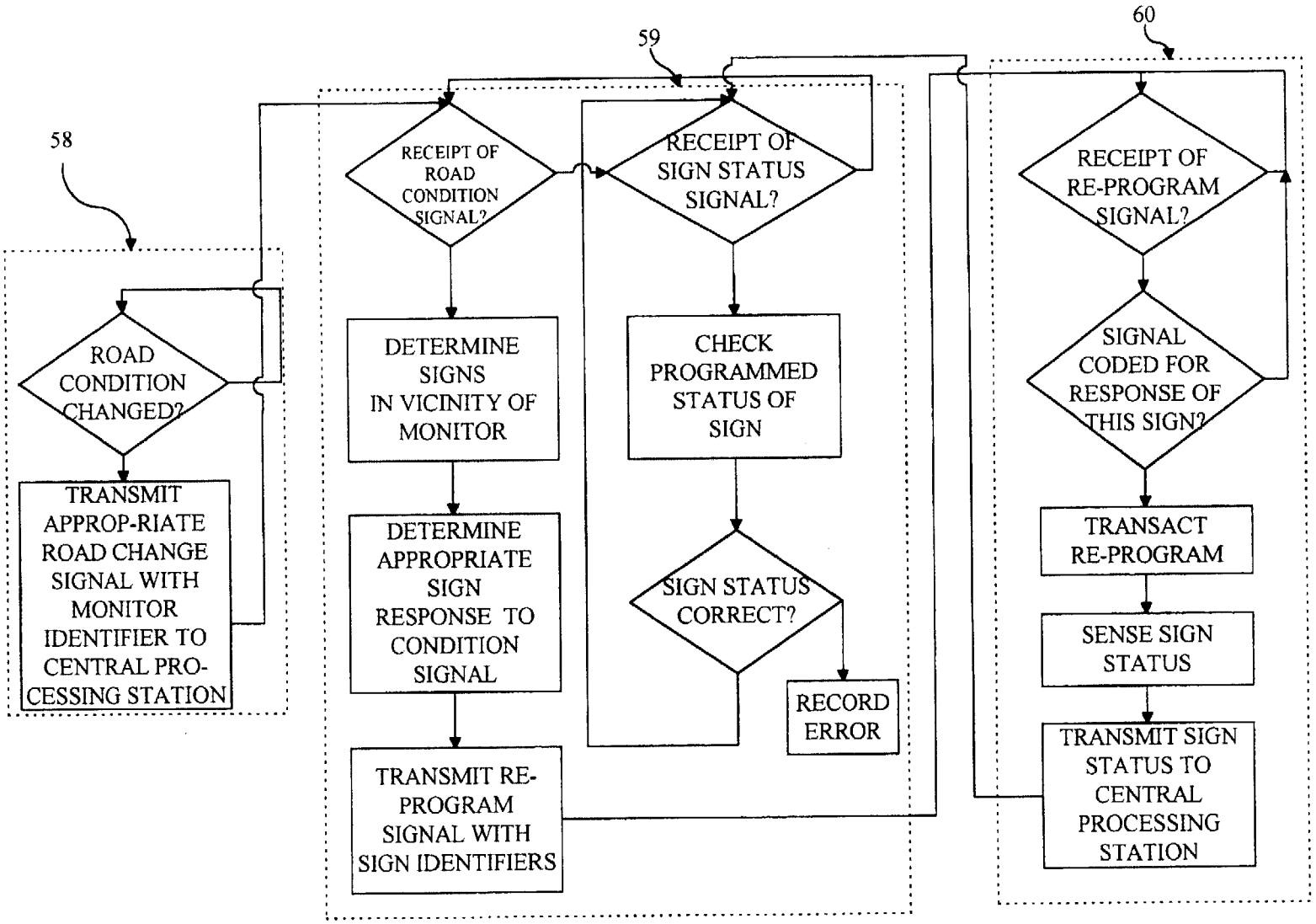
FIG. 6 is a flow diagram describing the processes involved in the present disclosed system.

FIG. 6 is a flow diagram describing the processes involved in the present disclosed system employing traffic signs. At 58 is shown a diagram of the process undertaken by condition monitor processor 49. Condition monitor processor 49 determines whether the road or traffic conditions have changed, and if such a change is detected transmits data relating to the road change with a monitor identifier to data processing unit 24 at central processing station 9.

The process undertaken by data processing means 24 is set forth at 59. Data processing means 24 determines whether the signal received relates to a changed condition, that is from condition monitor 49 or to a display medium status check by sensors 45 of display mediums 8. If the signal relates to a change of road or traffic condition, data processing means 24 determines which signs are in the vicinity of the monitor registering a change and by preprogrammed means determines the appropriate sign response to the changed condition. The command signal is then transmitted with a sign identifier, or key code, such that only particular messages on particular signs are altered according to a pre-prepared plan. If data processing means 24 determines that the signal relates to a display medium status check, data processing means 24 compares the status data against the desired status of the sign, and if such do not match, sends an error signal.

The process undertaken by display medium 8 is set forth at 59. Display medium 8 gauges whether a particular command signal received is coded for response by display medium 8. If the command signal is appropriately coded for action by display medium processor 44, then display processor 44 transacts the command portion of the command signal. Display sensors 45 upon prompting by display processor 44 sense parameters related to the display and/or operation of the display medium electronics and transmit data relating to the same to data processing means 24 at data processing station 9.

Figure 7A:
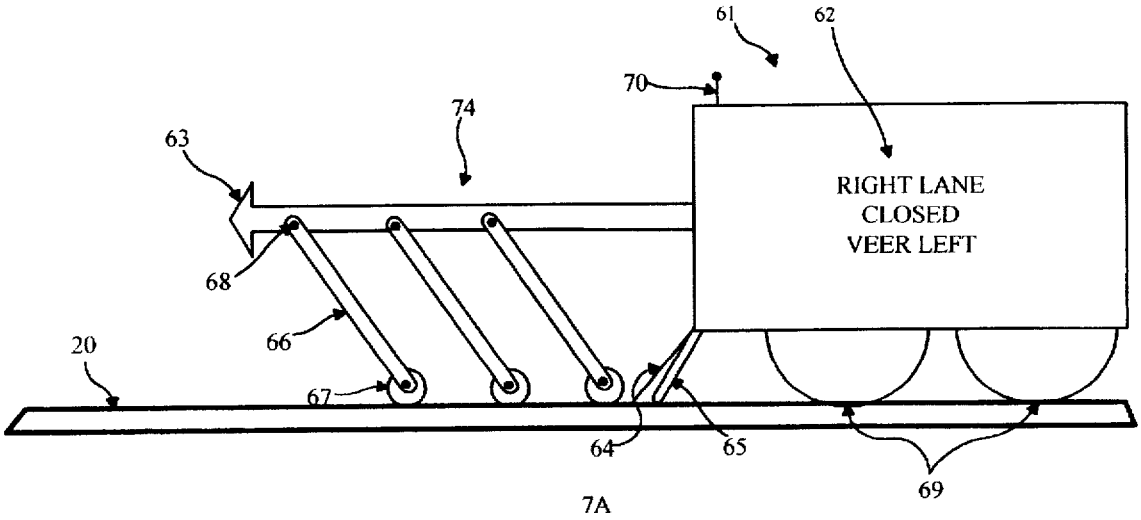
FIG. 7A and 7B are frontal and cross-sectional view, respectively, of an embodiment of a display medium of the present invention.
Figure 7B:
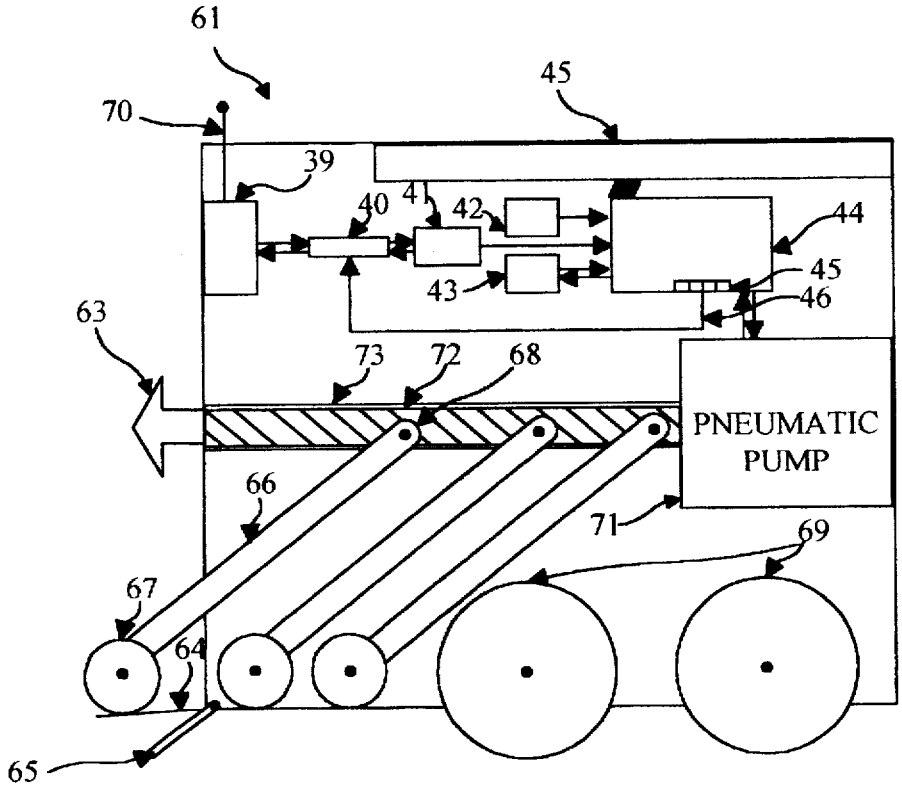

FIG. 7A and 7B are frontal and cross-sectional views, respectively, of an embodiment of a display medium of the present invention having a processor-activated means for activating a functionality in addition to, or other than, message display associated with the display medium. As depicted, in FIGS. 7A–7B, the command signal from the central processing station received from antenna 70 may activate a device such as pneumatic pump 71 which may be used to inflate or deflate a retractable protrusion means 74 having, for example, an end portion 72 for providing direction and body portion 63 housed in a protrusion housing 73. Retractable protrusion means 74 may be coupled to multiple protrusion support means 66, such means being coupled to the protrusion means by rotatable means 68 on one end and having a ground traversing means, such as wheel 67, on the other end, such as to support retractable protrusion means 74 on transit lane 20 when the protrusion is in dynamic and static extended state (FIG. 7A) and to permit easy storage of the protrusion support means 66 when the protrusion is in the retracted state (FIG. 7B). Display medium 61 may display a message 62 in accordance with the command signal as well as effectuating a change in the extension or retraction of retractable protrusion means 74. Display medium 61 may have wheels 69 or other ground traversing means to aid in the movement of display medium 61 and may have a support stand 65 to aid in substructural support. An incline means 64 may also be attached to elevated display medium 61 to permit easier disengagement and storage of protrusion support means 66. Other functionalities which may be activated by the command signal including a means to remotely move the display medium, such as a motor connected to a set of wheels by a mechanical linkage.

While this application has been described in connection with certain specific embodiments thereof, it should be understood that these are by way of example rather than by way of limitation, and it is not intended that the invention be restricted thereby.

What is claimed is:

1. A display system comprising:

a plurality of display mediums; said display mediums having a display transceiver means for receiving aerially-transmitted digitized signal bit streams and for transmitting aerial signals, display medium memory storage means for storing digital data, a display medium processor means electronically coupled with said transceiver means and said display medium memory storage means, said display medium processor means under control of a display medium data program routine stored in said display medium memory storage means for processing and storing data encoded in said digitized signal bit stream, a display means electronically coupled to said display medium processor means capable of visually displaying a non-preset number of images in response to said aerially-transmitted digitized signal bit stream, and a data recognition means electronically coupled to said display processor means for determining if a received transmission contains one or more data keys which are in accordance with a key protocol stored in said display memory storage means and permitting input of data encoded in said digitized signal bit stream into said display processor means only upon verification that such one or more data keys is in accord with said key protocol;

a plurality of condition monitor means for monitoring conditions in the vicinity of said condition monitor means and transmitting an aerial signal with respect to said conditions, said condition monitor means having a transceiver means for transmitting and receiving aerial signals, and a detection means electronically coupled to said transceiver means for detecting ambient conditions;

a central processing means disposed at a remote location from said plurality of mediums having a central processing transceiver means for aerially-transmitting a digitized signal bit stream to, and receiving aerial signals from, said condition monitor means, a central processing memory storage means for storing digital data, a central processing means co-processing means electronically coupled to said transceiver means and said central processing memory storage means, said central processing means co-processing means under control of a central processing data program routine stored in said central processing memory storage means for co-processing said aerial signals from said condition monitor means and effectuating transmission of said digitized signal bit stream in accordance with said central processing data program routine to said display mediums;

wherein one or more portions of said digital signal bit stream correspond to a command instruction data set interpretable by said display processor means and a data key data set interpretable by said data recognition means, said data key data set portion for unlocking said one or more display medium processor means responsive to said data key data set portion so as to permit reprogramming of said display medium data program routine or broadcast of a message or messages encoded in said digital signal bit stream signal in accordance with said command instruction data set portion of said digitized signal bit stream signal onto said display means of said unlocked display mediums and wherein said data key data set and command instruction data set of said digitized signal bit stream generated by said central processing means is generated in accordance with said central processing data program routine using data transmitted aerially to said central processing means from said plurality of condition monitor means.

2. The display system of claim 1 further comprising a plurality of spacially-positioned satellites for receiving said digitized data signals from said central processing means and transmitting the same back to said display mediums.

3. The display system of claim 1 wherein the condition monitor aerial signal is digital in nature.

4. The display system of claim 1 wherein said display medium processor means is programmed to periodically check the status of said display and to aerially transmit such status in signal form to said central processing means.

5. The display system of claim 4 wherein said central processing means is programmed to compare said actual status of said display against the desired status of said display and to generate an digitized signal bit stream in order to effectuate a change in said display so as to bring the actual status of said display into conformity with said desired status of said display.

6. A traffic control system for blocking off a portion of one or more transit areas from ingress or egress comprising:

a plurality of medium each having a retraction means for retracting, and an extension means for extending, a barrier means of sufficient size to block off ingress or egress with respect to said transit area, a transceiver means for receiving and transmitting aerial signals, and a processor means electronically coupled with said transceiver means and said retraction means for processing said aerial signals and effectuating movement of said barrier means by means of said retraction or extension means; said medium processor means having memory storage means and processing means for storing and processing data encoded in said aerial signals, and a data recognition means electronically coupled to said processor means for determining if a received transmission contains one or more data keys which are in accordance with a key protocol stored in said memory storage means and permitting input of data encoded in said aerial signal into said display processor means only upon verification that such key is in accord with said key protocol;

a central processing means disposed at a remote location from said plurality of mediums having a central processing transceiver means for transmitting a control signal for receipt by one or more said medium transceiver means, said control signal controlling said medium processor means for initiating extension or retraction of said barrier means from one or more of said mediums.

7. The control signal of claim 6 responsive to preprogrammed input regarding anticipated traffic conditions.

8. The traffic control system of claim 6 wherein the control signal is digital in nature.

9. The traffic control system of claim 6 wherein said medium processor means is programmed to periodically check the extension status of said barrier means and to aerially transmit such status in signal form to said central processing means.

10. The traffic control system of claim 9 wherein said central processing means is programmed to compare said actual extension status of said barrier means against the desired extension status of said barrier means and to generate an digitized signal bit stream in order to effectuate a change in said extension so as to bring the actual status of said extension into conformity with said desired status of said barrier means.

11. A method for controlling traffic patterns:

generating a digitized bit stream transmission signal and embedding therein a command instruction data set and a key data set, said data sets being interpretable by one or more processors, each having at least one memory storage means, of a plurality of traffic control mediums;

storing a data key program routine and unique medium identifiers in said memory storage means of said traffic control medium processors, said data key program routine structured so as to cause each of said processors to compare the unique medium identifier stored in said memory storage means of each traffic control medium processor to compare the unique medium identifier with said transmitted key data set upon receipt of said digitized bit stream transmission signal;

transmitting aerially said digitized bit stream transmission signal to said plurality of traffic control mediums;

causing each of said medium processors to compare said key data set of said digitized bit stream transmission signal with said unique medium identifier using said data key program routine, and causing said medium processor to effectuate said command instruction data set if said transmitted key data set is correlatable to said unique medium identifier stored in said memory storage unit of said traffic control medium, said command instruction set causing a change in said traffic control medium functioning whereby traffic patterns are changed.

* * * * *